US008600278B2

(12) United States Patent
Murakami et al.

(10) Patent No.: US 8,600,278 B2
(45) Date of Patent: Dec. 3, 2013

(54) FIXING DEVICE AND IMAGE FORMATION APPARATUS

(75) Inventors: Masanori Murakami, Toyohashi (JP); Tetsuya Kagawa, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/437,780

(22) Filed: Apr. 2, 2012

(65) Prior Publication Data

US 2012/0189361 A1 Jul. 26, 2012

Related U.S. Application Data

(63) Continuation of application No. 12/483,792, filed on Jun. 12, 2009, now Pat. No. 8,185,031.

(30) Foreign Application Priority Data

Jun. 19, 2008 (JP) ..... 2008-159959
Jul. 28, 2008 (JP) ..... 2008-193575

(51) Int. Cl.
*G03G 15/20* (2006.01)

(52) U.S. Cl.
USPC ..... 399/329

(58) Field of Classification Search
USPC ..... 399/329, 333, 330, 331, 122
See application file for complete search history.

(56) References Cited

U.S. PATENT DOCUMENTS

| | | | |
|---|---|---|---|
| RE38,810 | E | 10/2005 | Terada et al. |
| 2003/0183610 | A1 | 10/2003 | Okabayashi et al. |
| 2003/0185605 | A1 | 10/2003 | Okabayashi |
| 2004/0101334 | A1 | 5/2004 | Tatematsu et al. |
| 2007/0014601 | A1 | 1/2007 | Yasuda et al. |
| 2007/0127959 | A1 | 6/2007 | Tatematsu et al. |

FOREIGN PATENT DOCUMENTS

| | | |
|---|---|---|
| JP | 09-240879 | 9/1997 |
| JP | 2003-287969 | 10/2003 |
| JP | 2004-296368 | 10/2004 |
| JP | 2007-156065 | 6/2007 |
| JP | 11-327331 | 10/2007 |
| JP | 2007-264421 A | 10/2007 |
| WO | WO 2005/038533 | 4/2005 |

OTHER PUBLICATIONS

Notification of Reason for Refusal issued in the corresponding Japanese Patent Application No. 2008-193575 dated Jun. 1, 2010, and an English Translation thereof.

Decision to Grant a Patent issued in the corresponding Japanese Patent Application No. 2008-159959 dated Jun. 29, 2010, and an English Translation thereof.

*Primary Examiner* — Walter L Lindsay, Jr.
*Assistant Examiner* — Rodney Bonnette
(74) *Attorney, Agent, or Firm* — Buchanan Ingersoll & Rooney PC

(57) ABSTRACT

A fixing device for thermally fixing onto a sheet, an unfixed image formed on the sheet, includes: an endless belt that is heated by electromagnetic induction while being driven to rotate; a curved member that is positioned inside a rotation path of the belt and that is curved in an arc shape along the rotation path of the belt; a magnetic flux generator that (i) is positioned outside the rotation path of the belt, facing the curved member with the belt in between, and (ii) generates magnetic flux for heating the belt; a heat generation layer that is provided on the belt; a magnetic shunt alloy layer that is provided along the curved member, facing a protruding side of the curved member; and a magnetic flux nullifying layer that is provided on the curved member.

4 Claims, 12 Drawing Sheets

FIG. 4

| TEST SAMPLES | THICKNESS to OF CENTRAL PORTION (mm) | WHETHER THICK PORTIONS ARE PROVIDED | THICKNESS OF THICK PORTIONS (mm) | LENGTH OF THICK PORTIONS (mm) | MATERIAL |
|---|---|---|---|---|---|
| EMBODIMENT SAMPLE 1 | 0.5 | PROVIDED (IN BOTH ENDS) | 1.0 | CHANGED BETWEEN 1 mm, 3 mm and 5 mm | COPPER |
| EMBODIMENT SAMPLE 2 | | | 1.5 | | |
| EMBODIMENT SAMPLE 3 | | | 2.0 | | |
| CONVENTIONAL SAMPLE | | NOT PROVIDED | — | — | |

FIG. 11

| TEST SAMPLES | TOTAL LENGTH Lo (mm) | THICKNESS to (mm) | WHETHER ENDS ARE BENT | BENDING ANGLES $\theta_1$, $\theta_2$ (deg) | LENGTH OF BENT ENDS (mm) | | | MATERIAL |
|---|---|---|---|---|---|---|---|---|
| EMBODIMENT SAMPLE 1 | 35 | 0.5 | BENT | 10 | 1.7 | 3.5 | 5.2 | COPPER |
| EMBODIMENT SAMPLE 2 | | | | 15 | | | | |
| EMBODIMENT SAMPLE 3 | | | | 20 | | | | |
| CONVENTIONAL SAMPLE | | | NOT BENT | 0 | 0 | | | |

FIXING DEVICE AND IMAGE FORMATION APPARATUS

CROSS-REFERENCE TO RELATED APPLICATIONS

This application is a continuation of U.S. application Ser. No. 12/483,792 filed on Jun. 12, 2009, which claims priority to Japanese Application Nos. 2008-159959 filed on Jun. 19, 2008 and 2008-193575 filed on Jul. 28, 2008, the entire contents of which are incorporated herein by reference.

This application is based on applications No. 2008-159959 and No. 2008-193575 filed in Japan, the contents of which are hereby incorporated by reference.

BACKGROUND OF THE INVENTION

1. Field of the Invention

The present invention relates to a fixing device and an image formation apparatus. In particular, the present invention relates to technology used in a fixing device comprising a guide plate that guides an induction-heated belt in its rotation direction to suppress the guide plate from generating heat and improve heating efficiency of the belt.

2. Description of Related Art

In recent years, image formation apparatuses (e.g., printers) are starting to incorporate an energy-saving fixing device of an electromagnetic induction-heating type, rather than a fixing device using a halogen heater as a heat source (Japanese Laid-Open Patent Application No. 2007-264421).

FIG. 14 is a cross-sectional view showing the structure of a fixing device 300 of an electromagnetic induction-heating type.

As shown in FIG. 14, the fixing device 300 is composed of: a fixing belt 301; a fixing roller 302; a pressure roller 303; a magnetic flux generator 304; a guide plate 305; and so on.

The fixing belt 301 is a cylindrical, elastically deformable belt comprising an induction-heated layer 301*a* and a magnetic shunt alloy layer 301*b* that is provided on the back of the induction-heated layer 301*a*. The fixing belt 301 is driven and rotated in the direction of arrow P.

The magnetic shunt alloy layer 301*b* has the property that it is ferromagnetic at ambient temperature, but turns nonmagnetic at temperatures above the Curie temperature.

The fixing roller 302 is positioned inside the rotation path of the fixing belt 301. The pressure roller 303 is positioned outside the rotation path of the fixing belt 301. A fixing nip 310 is formed by the pressure roller 303 pressing the fixing roller 302 with the fixing belt 301 in between. The pressure roller 303 rotates in the direction of arrow Q by receiving a driving force from a driving motor (not illustrated). The fixing roller 302 and the fixing belt 301 are driven and rotated due to this driving force acting thereon.

The magnetic flux generator 304 is positioned outside the rotation path of the fixing belt 301, in such a manner that the fixing belt 301 is positioned between the magnetic flux generator 304 and the pressure roller 303. The magnetic flux generator 304 generates magnetic flux for causing the induction-heated layer 301*a* of the fixing belt 301 to generate heat.

The guide plate 305 is a nonmagnetic member made from a low-resistance and electrically conductive material. The guide plate 305 is positioned inside the rotation path of the fixing belt 301, in such a manner that the guide plate 305 faces the magnetic flux generator 304 with the fixing belt 301 in between. The guide plate 305 is curved along the curvature of the fixing belt 301. The guide plate 305 controls relative positions of the fixing belt 301 and the magnetic flux generator 304, while guiding the fixing belt 301 in its rotation direction by the surface of the guide plate 305 coming into contact with the inner surface of the rotating fixing belt 301.

In the fixing device 300 configured in the above manner, once the magnetic flux generator 304 starts generating the magnetic flux during the driving/rotation of the fixing belt 301, heat is generated mainly in a portion of the induction-heated layer 301*a* of the fixing belt 301, the portion facing the magnetic flux generator 304. Once this heat-generating portion of the induction-heated layer 301*a* reaches the fixing nip 310, the temperature of and in the vicinity of the fixing nip 310 is increased to a temperature suited for the fixing. Then, when toner images formed on a sheet S pass through the fixing nip 310, the toner images are thermally fixed onto the sheet S by thermocompression.

At this time, the temperature of a central portion of the fixing belt 301 that comes in contact with the sheet S is lowered, as the sheet S draws heat from the central portion of the fixing belt 301; however, the temperature of both edges of the fixing belt 301 that do not come in contact with the sheet S (hereinafter, "contactless portions of the fixing belt 301") remains high, as the heat thereof is not drawn by the sheet S. In such a situation, if power is supplied to the magnetic flux generator 304 so as to set the central portion of the fixing belt 301 at a target temperature, the temperature of the contactless portions will further increase.

If portions of the magnetic shunt alloy layer 301*b* corresponding to the contactless portions of the fixing belt 301 (hereinafter, "contactless portions of the magnetic shunt allow layer 301*b*") are heated to the point where the temperature thereof exceeds the Curie temperature, the contactless portions of the magnetic shunt alloy layer 301*b* turns from ferromagnetic to nonmagnetic. As a result, the magnetic flux, which had been carried along the magnetic shunt alloy layer 301*b*, penetrates through the magnetic shunt alloy layer 301*b* and breaks into the guide plate 305.

As the guide plate 305 is made from a low-resistance and electrically conductive material, an eddy current produced by the magnetic flux that is breaking into the guide plate 305 contributes to generation of magnetic flux whose direction cancels out the magnetic flux that is breaking into the guide plate 305, rather than to generation of heat. Consequently, the magnetic flux density in the contactless portions of the fixing belt 301 is reduced, thus alleviating temperature increase therein.

As set forth above, the fixing device 300 has excellent thermal efficiency because the fixing belt 301 itself generates heat. Moreover, due to the interaction between the magnetic shunt alloy layer 301*b* and the guide plate 305, the fixing device 300 can automatically perform temperature control so as not to overheat the contactless portions of the fixing belt 301.

However, even though the guide plate 305 is made from a low-resistance and electrically conductive material, it is still unavoidable that the eddy current generates heat. Furthermore, because the guide plate 305 is thin (i.e., has a thickness of approximately 0.5 mm), if the fixing device 300 continuously executes the fixing for small-sized sheets for a long period of time, the amount of said heat will be accumulated and the temperature of the guide plate 305 will be excessively increased. This may thermally deform the guide plate 305.

One way to avoid this problem is to raise heat capacity of the guide plate 305 by increasing the thickness of the guide plate 305. This, however, raises an amount of heat that the fixing belt 301 draws from the guide plate 305 because they are in contact with each other, and therefore creates another problem where it takes time to complete a warm-up.

Furthermore, although the above fixing device of the electromagnetic induction-heating type has an excellent heating efficiency due to the fixing belt 301 generating heat on its own by induction heating, further improvements in heating efficiency has been demanded with the current trend of energy conservation.

SUMMARY OF THE INVENTION

The present invention has been made in view of the above problems and demand. The first object of the present invention is to provide a fixing device and an image formation apparatus that can suppress an excessive increase in the temperature of the guide plate with the warm-up time period hardly extended.

The second object of the present invention is to, in a fixing device of the electromagnetic induction-heating type and an image formation apparatus using the same, further improve the heating efficiency of the fixing device.

The first object is achieved by a fixing device for causing a sheet, on which an unfixed image has been formed, to pass through a fixing nip, and thus thermally fixing the unfixed image onto the sheet, the fixing device comprising: an endless belt that is heated by electromagnetic induction while being driven to rotate; a first roller positioned inside a rotation path of the belt; a second roller operable to form the fixing nip between an outer surface of the belt and the second roller, by pressing the first roller from outside the rotation path of the belt with the belt in between; a guide plate that (i) extends, inside the rotation path of the belt, in parallel with a rotation axis of the first roller, and (ii) guides the belt in a rotation direction thereof by coming into contact with an inner surface of the belt; and a magnetic flux generator that (i) is positioned outside the rotation path of the belt, facing the guide plate with the belt in between, and (ii) generates magnetic flux for heating the belt, wherein the belt includes a heat generation layer that generates heat due to the magnetic flux, and a magnetic shunt alloy layer that reversibly turns from ferromagnetic to nonmagnetic when a temperature thereof has exceeded a predetermined temperature, the guide plate includes a low-resistance and electrically conductive layer, and at least one of ends of the guide plate in the rotation direction is a thick portion having a greater thickness than a central portion of the guide plate.

The above structure enables the magnetic flux to easily break into the surface of an end of the guide plate. As the at least one of ends of the guide plate is the thick portion having a greater thickness than the central portion of the guide plate, the electric current density in the thick portion is reduced, thus suppressing the guide plate from generating heat.

Moreover, with the above structure, the thickness of the central portion of the guide plate, which is other than the thick portion, is small. Therefore, heat capacity of the aforementioned guide plate is merely slightly higher than that of a guide plate having no thick portions at all. Use of the aforementioned guide plate does not cause a significant change in a warm-up time period, either.

The first object is also achieved by an image formation apparatus that includes a fixing device for causing a sheet, on which an unfixed image has been formed, to pass through a fixing nip, and thus thermally fixing the unfixed image onto the sheet, the fixing device comprising: an endless belt that is heated by electromagnetic induction while being driven to rotate; a first roller positioned inside a rotation path of the belt; a second roller operable to form the fixing nip between an outer surface of the belt and the second roller, by pressing the first roller from outside the rotation path of the belt with the belt in between; a guide plate that (i) extends, inside the rotation path of the belt, in parallel with a rotation axis of the first roller, and (ii) guides the belt in a rotation direction thereof by coming into contact with an inner surface of the belt; and a magnetic flux generator that (i) is positioned outside the rotation path of the belt, facing the guide plate with the belt in between, and (ii) generates magnetic flux for heating the belt, wherein the belt includes a heat generation layer that generates heat due to the magnetic flux, and a magnetic shunt alloy layer that reversibly turns from ferromagnetic to nonmagnetic when a temperature thereof has exceeded a predetermined temperature, the guide plate includes a low-resistance and electrically conductive layer, and at least one of ends of the guide plate in the rotation direction is a thick portion having a greater thickness than a central portion of the guide plate.

The second object is achieved by a fixing device for causing a sheet, on which an unfixed image has been formed, to pass through a fixing nip, and thus thermally fixing the unfixed image onto the sheet, the fixing device comprising: an endless belt that is heated by electromagnetic induction while being driven to rotate; a first roller positioned inside a rotation path of the belt; a second roller operable to form the fixing nip between an outer surface of the belt and the second roller, by pressing the first roller from outside the rotation path of the belt with the belt in between; a guide plate that (i) extends, inside the rotation path of the belt, in parallel with a rotation axis of the first roller, and (ii) guides the belt in a rotation direction thereof by coming into contact with an inner surface of the belt; and a magnetic flux generator that (i) is positioned outside the rotation path of the belt, facing the guide plate with the belt in between, and (ii) generates magnetic flux for heating the belt, wherein the belt includes a heat generation layer that generates heat due to the magnetic flux, and a magnetic shunt alloy layer that reversibly turns from ferromagnetic to nonmagnetic when a temperature thereof has exceeded a predetermined temperature, the magnetic shunt alloy layer being closer to an inner side of the belt than the heat generation layer, the guide plate includes a low-resistance and electrically conductive layer, and at least one of ends of the guide plate in the rotation direction has been bent away from the belt.

The above structure suppresses reduction of magnetic flux that contributes to heating the belt of the fixing device, thus improving the heating efficiency of the fixing device.

That is to say, even when the magnetic shunt alloy layer is at or below the predetermined temperature and is thus ferromagnetic, the magnetic shunt alloy layer cannot capture the entire magnetic flux generated by the magnetic flux generator. Leaked magnetic flux reaches the inside of the rotation path of the fixing belt. As the leaked magnetic flux tends to converge, especially on the surface of an end of the guide plate in the belt rotation direction, an eddy current is produced thereat. This eddy current causes generation of magnetic flux that proceeds in the opposite direction from the leaked magnetic flux (hereinafter, "canceling magnetic flux"). The canceling magnetic flux is thought to cancel out a part of the magnetic flux generated by the magnetic flux generator, and accordingly to reduce the magnetic flux density of the magnetic flux penetrating through the heat generation layer.

However, according to the present invention, at least one of ends of the guide plate has been bent away from the belt. This extends the distance between the bent end of the guide plate and the magnetic flux generator, and thus reduces the amount of leaked magnetic flux converging on the bent end of the guide plate. Consequently, the absolute amount of the canceling magnetic flux generated at the surface of an end of the guide plate is reduced. Compared to conventional technology, this contributes to heating the heat generation layer more efficiently without canceling out the magnetic flux generated by the magnetic flux generator, thus improving the heating efficiency.

The second object is also achieved by an image formation apparatus that includes a fixing device for causing a sheet on which an unfixed image has been formed to pass through a fixing nip, and thus thermally fixing the unfixed image onto the sheet, the fixing device comprising: an endless belt that is heated by electromagnetic induction while being driven to rotate; a first roller positioned inside a rotation path of the belt; a second roller operable to form the fixing nip between an outer surface of the belt and the second roller, by pressing the first roller from outside the rotation path of the belt with the belt in between; a guide plate that (i) extends, inside the rotation path of the belt, in parallel with a rotation axis of the first roller, and (ii) guides the belt in a rotation direction thereof by coming into contact with an inner surface of the belt; and a magnetic flux generator that (i) is positioned outside the rotation path of the belt, facing the guide plate with the belt in between, and (ii) generates magnetic flux for heating the belt, wherein the belt includes a heat generation layer that generates heat due to the magnetic flux, and a magnetic shunt alloy layer that reversibly turns from ferromagnetic to nonmagnetic when a temperature thereof has exceeded a predetermined temperature, the magnetic shunt alloy layer being closer to an inner side of the belt than the heat generation layer, the guide plate includes a low-resistance and electrically conductive layer, and at least one of ends of the guide plate in the rotation direction has been bent away from the belt.

BRIEF DESCRIPTION OF THE DRAWINGS

These and other objects, advantages and features of the invention will become apparent from the following description thereof taken in conjunction with the accompanying drawings that illustrate specific embodiments of the invention.

In the drawings:

FIG. 4 shows specifications of samples on which a simulation pertaining to Embodiment 1 has been performed;

FIG. 11 shows specifications of samples on which a simulation pertaining to Embodiment 2 has been performed;

DESCRIPTION OF PREFERRED EMBODIMENTS

The following describes embodiments of an image formation apparatus pertaining to the present invention, the image formation apparatus specifically being a tandem digital color printer (hereinafter, simply "printer") as an example.

(1) Overall Structure of Printer

Figure 1:
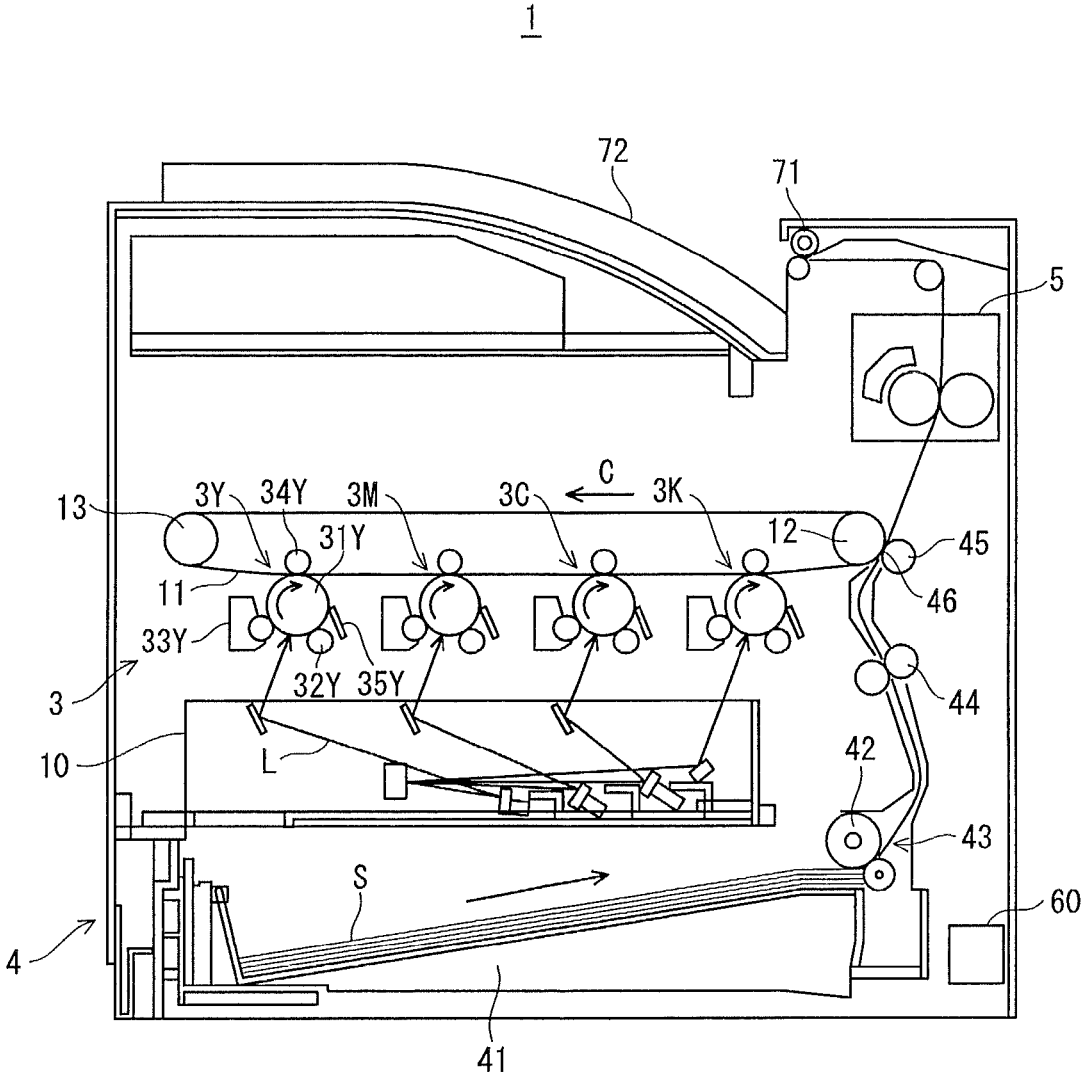
FIG. 1 is a schematic cross-sectional view of a tandem digital color printer pertaining to Embodiments 1 and 2.

FIG. 1 is a schematic cross-sectional view showing an overall structure of a printer 1.

As shown in FIG. 1, the printer 1 is composed of an image processor 3, a feeder 4, a fixer 5 and a controller 60, and is connected to a network (e.g., LAN). Upon receiving an instruction to execute a print job from an external terminal apparatus (not illustrated), the printer 1 forms toner images of colors yellow, magenta, cyan and black, and performs full-color image formation by multiple-transferring the formed toner images.

Hereinafter, the yellow, magenta, cyan and black reproduction colors will be represented as Y, M, C and K, respectively, and the letters Y, M, C, and K will be appended to reference numbers of components relating to the reproduction colors.

The image processor 3 includes: image formers 3Y, 3M, 3C and 3K; an optical unit 10; an intermediate transfer belt 11; and so on.

The image former 3Y includes: a photosensitive drum 31Y; a charger 32Y; a developer 33Y; a primary transfer roller 34Y; a cleaner 35Y for cleaning the photosensitive drum 31Y; and so on. The charger 32Y, the developer 33Y, the primary transfer roller 34Y, and the cleaner 35Y are all positioned surrounding the photosensitive drum 31Y. The image former 3Y forms a color Y toner image on the photosensitive drum 31Y.

Other image formers 3M to 3K are different from the image former 3Y only in that they form images of different colors than the image former 3Y. Other than that, the image formers 3M to 3K have similar structures to the image former 3Y, and respectively include chargers 32M to 32K, etc. For simplicity, reference numbers of components of the image formers 3M to 3K are omitted in FIG. 1.

The intermediate transfer belt 11 is an endless belt suspended in a tensioned state on a driving roller 12 and a driven roller 13, and is driven and rotated in the direction of arrow C.

The optical unit 10 includes luminous elements such as laser diodes. With a drive signal transmitted from the controller 60, the optical unit 10 performs exposure scanning of the photosensitive drums 31Y to 31K by emitting laser beams L for forming images in colors Y to K.

This exposure scanning forms electrostatic latent images on the photosensitive drums 31Y to 31K that have been charged by the charges 32Y to 32K. The electrostatic latent images are developed by the developers 33Y to 33K. The toner images of colors Y to K, which have been formed on the photosensitive drums 31Y to 31K, are primary-transferred on the intermediate transfer belt 11 at different timings, so that the toner images of colors Y to K are layered on the intermediate transfer belt 11 in the same position.

The toner images of colors Y to K are sequentially transferred to the intermediate transfer belt 11 by electrostatic power acting on primary transfer rollers 34Y to 34K. These toner images as a whole constitute a full-color toner image, so to speak. These toner images are then carried to a secondary transfer position 46.

The feeder 4 includes: a paper feed cassette 41 that contains a sheet S; a pickup roller 42 that picks up the sheet S of the paper feed cassette 21 and directs the sheet S onto a conveyance path 43, one sheet at a time; a pair of timing rollers 44 for adjusting a timing to convey the picked sheet S to the secondary transfer position; and so on. The sheet S is conveyed from the feeder 4 to the secondary transfer position, in accordance with a timing at which the toner images are conveyed on the intermediate transfer belt 11. The toner images on the intermediate transfer belt 11 are collectively secondary-transferred to the sheet S by electrostatic power acting on the secondary transfer roller 45.

After passing the secondary transfer position 46, the sheet S is continuously conveyed by the fixer 5. Once the toner images formed on the sheet S (unfixed at this point) are fixed onto the sheet S by thermocompression in the fixer 5, the sheet S is discharged to a discharge tray 72 via a pair of discharge rollers 71.

(2) Structure of Fixer

Figure 2:
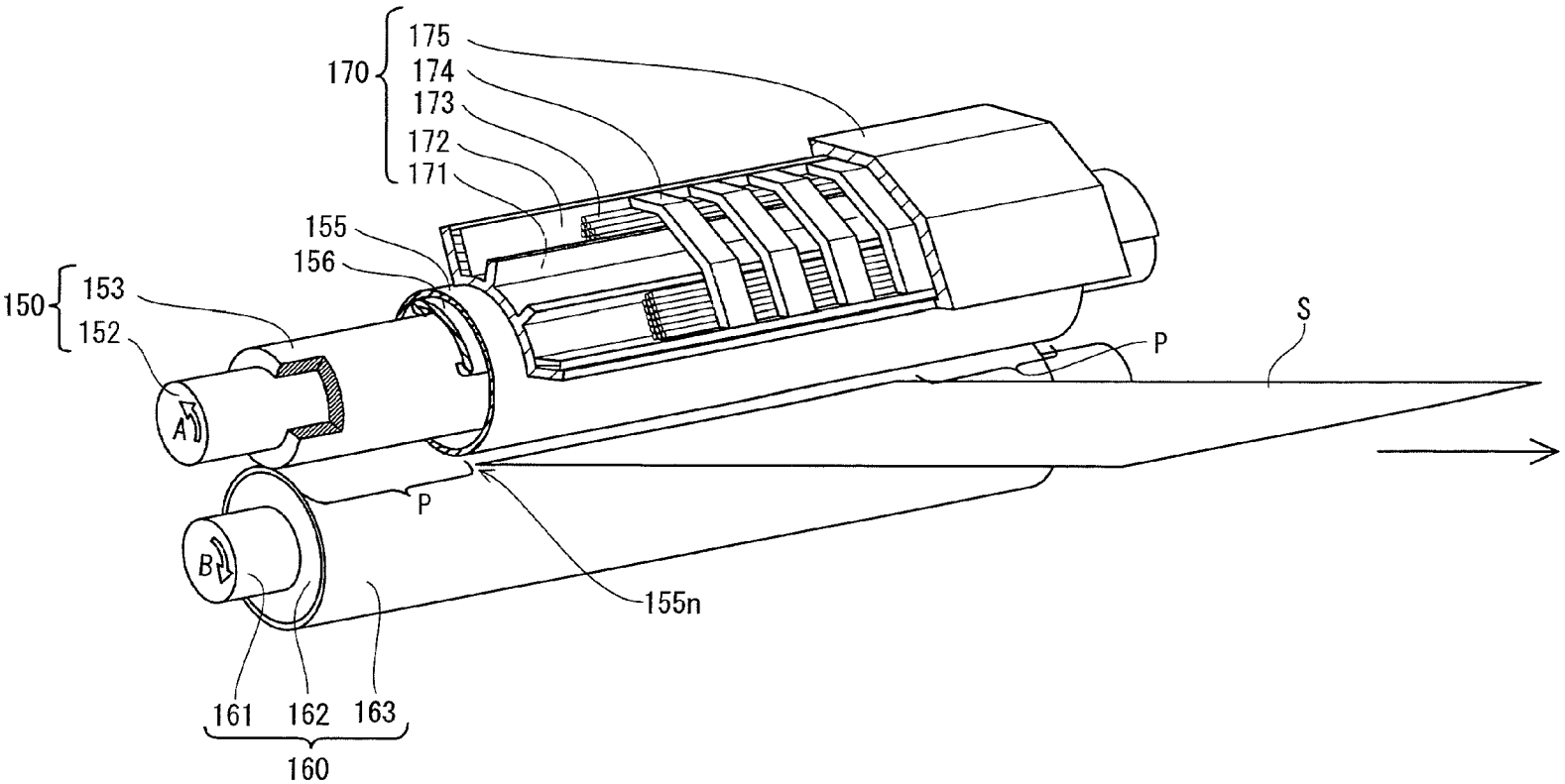
FIG. 2 is a partial perspective and cross-sectional view of a fixer pertaining to Embodiments 1 and 2.
Figure 3:
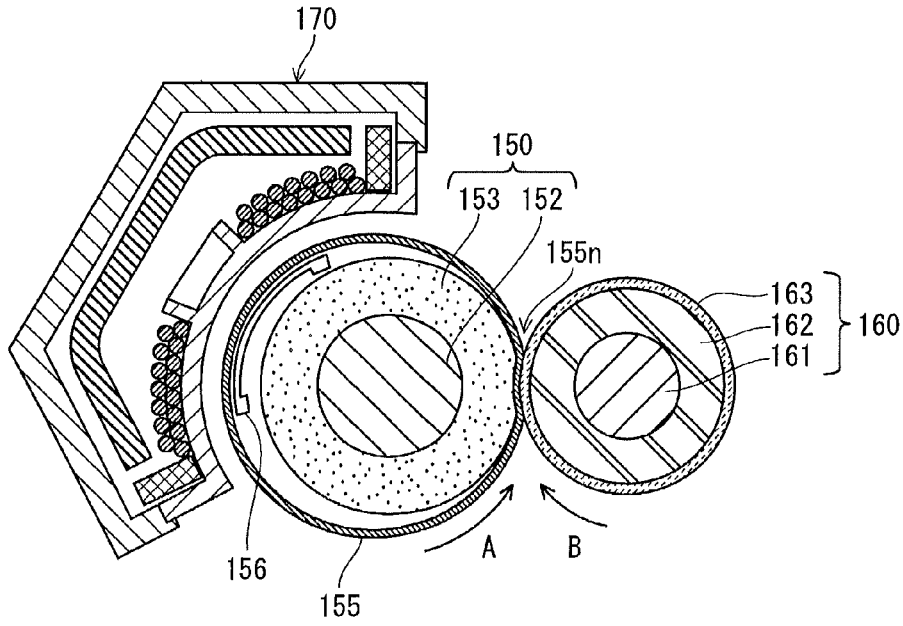
FIGS. 3A and 3B are longitudinal cross-sectional views showing structures of major components of the fixer pertaining to Embodiment 1.
FIG. 3C is a partial cross-sectional view of a fixing belt.
Figure 3:
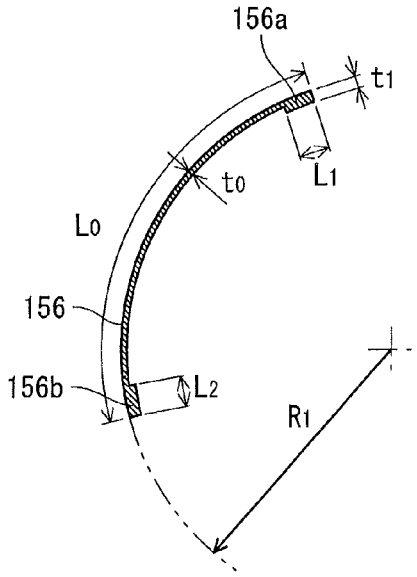
Figure 3:
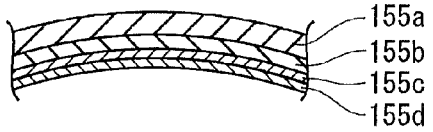

FIG. 2 is a partial perspective and cross-sectional view showing the structure of the above fixer 5. FIGS. 3A and 3B are longitudinal cross-sectional views showing major components of the fixer 5.

As shown in FIG. 2, the fixer 5 includes: a fixing roller 150; a fixing belt 155; a guide plate 156; a pressure roller 160; and a magnetic flux generator 170.

As shown in FIG. 3A, the fixing roller 150 is composed of an elongated, cylindrical metal core 152 and an elastic layer 153 that wraps the circumference of the metal core 152. The fixing roller 150 is positioned inside the rotation path of the fixing belt 155 (the path along which the fixing belt 155 is rotated).

The metal core 152 is a cylinder having an outer diameter of approximately 20 mm, and is made of aluminum, iron, stainless steel, or the like.

The elastic layer 153 has, for example, a thickness of approximately 10 mm. The fixing roller 150 has an outer diameter of approximately 40 mm.

The elastic layer 153 is made from a foamed elastic material such as silicone rubber and fluororubber. It is desirable that the elastic layer 153 be made from a material with high heat resistance and high thermostability.

The pressure roller 160 is formed by layering, on the circumference of a cylindrical metal core 161, an elastic layer 162 and a releasing layer 163 in listed order. The pressure roller 160 is positioned outside the rotation path of the fixing belt 155. The pressure roller 160 forms a fixing nip 155*n* between the outer surface thereof and the outer surface of the fixing belt 155, by pressing the fixing roller 150 from outside the fixing belt 155 with the fixing belt 155 in between, the fixing nip having a predetermined width in the rotation direction of the pressure roller 160.

The metal core 161 is made of aluminum or the like. The elastic layer 162 is made from silicone sponge rubber or the like. The releasing layer 163 is, for example, a PFA (tetrafluoroethylene-perfluoro (alkyl vinyl ether) copolymer) or a PTFE (polytetrafluoroethylene) coating. The pressure roller 160 has an outer diameter of approximately 35 mm.

Axial ends of the metal cores 152 and 161 of the fixing roller 150 and the pressure roller 160 are each rotatably supported by shaft bearings of a frame (not illustrated). The pressure roller 160 is driven and rotated in the direction of arrow B due to a driving force acting on the pressure roller 160, the driving force being provided by a driving motor (not illustrated). This rotation of the pressure roller 160 drives and rotates the fixing belt 155 and the fixing roller 150 in the direction of arrow A.

The fixing belt 155 is a cylindrical belt. As shown in FIG. 3C, the fixing belt 155 is formed by layering a magnetic shunt alloy layer 155*d*, a heat generation layer 155*c*, an elastic layer 155*b* and a releasing layer 155*a* in listed order, so that the releasing layer 155*a* is the outermost layer.

The fixing belt 155 can independently keep its cylindrical shape.

The width of the fixing belt 155 in the belt width direction (i.e., the direction of the rotation axis of the fixing roller 150) is longer than the width of a sheet of the largest size in the sheet width direction.

The releasing layer 155*a* is a cylinder made from PFA or the like. From an experience point of view, it is desirable that the thickness of the releasing layer 155*a* be arbitrarily determined within a range from 30 μm to 40 μm, inclusive.

The elastic layer 155*b* is made of, for example, silicone rubber having a thickness of approximately 200 μm.

The elastic layer 155*b* may be made from fluororubber or the like, instead of silicone rubber.

The heat generation layer 155*c* is made of, for example, a nickel plate having a thickness of approximately 40 μm. The heat generation layer 155*c* generates heat due to the magnetic flux generated by the magnetic flux generator 170.

Made of a nickel-iron alloy or the like, the magnetic shunt alloy layer 155*d* has a thickness of, for example, approximately 30 μm. The magnetic shunt alloy layer 155*d* has the property that it is ferromagnetic at ambient temperature, but turns nonmagnetic at temperatures above the Curie temperature. The Curie temperature is variable depending on the nickel-iron mixing rate. In the embodiments, the Curie temperature is 20° C. higher than a temperature suited for the fixing (a target temperature).

The magnetic shunt alloy layer 155*d* may be made of a nickel-iron-chrome alloy or the like, instead of the nickel-iron alloy.

Turning to FIG. 2, the magnetic flux generator 170 is composed of a coil bobbin 171, edge cores 172, an excitation coil 173, cores 174, and a cover 175. The magnetic flux generator 170 is positioned outside the rotation path of the fixing belt 155. Provided that a reference point is on the opposite side of the fixing belt 155 across from the pressure roller 160, the magnetic flux generator 170 is positioned slightly more upstream in the rotation direction of the fixing belt 155 than the reference point, in such a manner that the magnetic flux generator 170 extends along the width direction of the fixing belt 155.

The excitation coil 173 generates magnetic flux for heating the heat generation layer 155*c* of the fixing belt 155, and is wound around the coil bobbin 171.

The cores 174 and the edge cores 172 direct the alternating magnetic flux generated by the excitation coil 173 toward the fixing belt 155. The alternating magnetic flux penetrates through mainly a portion of the heat generation layer 155*c* (see FIG. 3C) of the fixing belt 155, the portion facing the magnetic flux generator 170. As a result, said portion of the heat generation layer 155*c* produces an eddy current. This causes the heat generation layer 155*c* to generate heat, thus heating the fixing belt 155. Due to an increase in the temperature of the fixing belt 155, the temperature of the pressure roller 160, which is in contact with the fixing belt 155 at the fixing nip 155*n*, is increased as well.

A sensor (not illustrated) is supplementarily provided to detect the surface temperature of the central portion of the fixing belt 155 in the belt width direction. The controller 60 controls power supplied to the excitation coil 173 in accordance with a detection signal transmitted from the sensor, so that the temperature of the fixing belt 155 is maintained at a target temperature (approximately 180° C.).

When the sheet S passes through the fixing nip 155*n* with the temperature of the fixing nip 155*n* maintained at the target temperature, unfixed toner images formed on the sheet S are thermally fixed onto the sheet S by thermocompression (see FIG. 2).

Made from a nonmagnetic, low-resistance and electrically conductive material, the guide plate 156 is an elongated plate-like member placed in parallel with the axis of the fixing roller 150. The guide plate 156 guides the fixing belt 155 in its rotation direction by the surface of the guide plate 156 coming into contact with the inner surface of the fixing belt 155.

To be more specific, the aforementioned low-resistance and electrically conductive material denotes copper. Instead of copper, the aforementioned low-resistance and electrically conductive material may be aluminum or the like.

Both ends of the guide plate 156 in the longitudinal direction are supported by the frame (not illustrated).

(3) Configurations of Guide Plate

Inventors of the present invention (hereinafter, simply "the inventors") have discovered configurations of a guide plate that are suited to serve the following purposes when applied to the above-described structures: (i) suppressing an excessive increase in the temperature of the guide plate without extending the warm-up time period; and (ii) further improving heating efficiency of the fixing device.

<Embodiment 1>

The configuration of a guide plate 156 pertaining to Embodiment 1 is suited to suppress an excessive increase in the temperature of the guide plate 156 with the warm-up time period hardly extended.

That is to say, as shown in FIG. 3B, the guide plate 156 has a total length of $L_0$ in the belt rotation direction. The guide plate 156 is formed by curving a plate whose both ends in the belt rotation direction are thick portions 156*a* and 156*b* each of which is thicker than the central portion of the plate. Here, the plate is curved in such a manner that its outer circumferential surface has a radius of curvature $R_1$.

Here, the total length $L_0$ is 35 mm, and the radius of curvature $R_1$ is 20 mm.

The lengths $L_1$ and $L_2$ of the thick portions 156*a* and 156*b* are each 1 mm, and the thicknesses $t_1$ and $t_2$ of the thick portions 156*a* and 156*b* are each 1.5 mm. The thickness $t_0$ of the central portion of the plate is 0.5 mm.

The radius of curvature $R_1$ of the guide plate 156 is substantially equal to the radius of curvature pertaining to the inner surface of a portion of the fixing belt 155 facing the magnetic flux generator 170 when the fixed belt 155 is not rotating.

When the temperature of the magnetic shunt alloy layer 155*d* is equal to or lower than the Curie temperature and thereby ferromagnetic (hereinafter, "before the magnetic shunt effect is achieved"), the magnetic flux generated by the magnetic flux generator 170 proceeds through a part of the fixing belt 155 that faces the axis around which the excitation coil 173 has been wound, penetrating through the heat generation layer 155*c* of the fixing belt 155 and breaking into the magnetic shunt alloy layer 155*d*. Thereafter, inside the magnetic shunt alloy layer 155*d*, said magnetic flux bifurcates in the upstream and downstream directions along the belt rotation direction, and proceeds toward the nearest one of the edge cores 172.

At this time, the heat generation layer 155*c* is induction-heated by the eddy current produced by the magnetic flux penetrating through the heat generation layer 155*c*.

After the temperature of the contactless portions of the magnetic shunt alloy layer 155*d* has exceeded the Curie temperature and has thus turned from ferromagnetic to nonmagnetic (hereinafter, "after the magnetic shunt effect is achieved"), the magnetic flux generated by the magnetic flux generator 170 penetrates through the heat generation layer 155*c* and the magnetic shunt alloy layer 155*d*, and further breaks into the guide plate 156.

At this time, the guide plate 156 generates magnetic flux that proceeds in the opposite direction from the magnetic flux that is breaking into the guide plate 156. This reduces the magnetic flux density in and in the vicinity of the guide plate 156, thus suppressing overheating of the heat generation layer 155*c*.

Consequently, in a case where the printer 1 executes a print job of sequentially printing on a large number of small-sized sheets, the temperature of contactless portions P of the fixing belt 155 (see FIG. 2) would not be increased to the point where it significantly exceeds the Curie temperature (a target temperature at which the fixing belt 155 is controlled to remain +20° C.). This prevents the temperature of the contactless portions P of the fixing belt 155 from getting high enough to damage the fixing belt 155.

It should be noted here that the Curie temperature is not limited to being set at the above-described temperature. The Curie temperature may be arbitrarily determined from experiments etc. in accordance with the structure of the fixer 5 or the like, so that (i) the temperature of a portion of the fixing belt 155 that comes into contact with a sheet is maintained at a predetermined fixing temperature, and (ii) the temperature of the contactless portions of the fixing belt 155 is not excessively increased.

<Effects of Providing Thick Portions in Ends of Guide Plate 156>

Through diligent studies, the inventors have discovered that the temperature increase in the guide plate 156, whose both ends in the belt rotation direction are the thick portions 156*a* and 156*b* that are thicker than the central portion of the guide plate 156, is more alleviated than the temperature increase in a conventional guide plate having no thick portions.

Also, the lengths $L_1$ and $L_2$ of the thick portions 156*a* and 156*b* in the belt rotation direction are each 1 mm—i.e., short. In other words, providing the thick portions 156*a* and 156*b* hardly increases the volume or heat capacity of the guide plate 156, and does not extend the warm-up time period, either.

<Results of Simulation>

To verify the above effects, the inventors computer simulated the temperature of the guide plate 156 before and after achievement of the magnetic shunt effect, by using the finite element method. The following results were obtained.

<Specifications of Test Samples>

FIG. 4 shows specifications of guide plates 156 provided as embodiment samples 1, 2 and 3 (pertaining to the present invention) and a conventional guide plate 156 provided as a conventional sample, which were all subjected to the simulation.

As shown in FIG. 4, ends of each of the embodiment samples 1, 2 and 3 in the belt rotation direction are the thick portions. The thick portions of the embodiment samples 1, 2 and 3 had thicknesses of 1.0 mm, 1.5 mm and 2.0 mm, respectively. Central portions of the embodiment samples 1, 2 and 3 had a uniform thickness of 0.5 mm, the central portions being other than the thick portions.

Here, the simulation was performed three times each on the embodiment samples 1, 2 and 3, in which the length of the thick portions in the belt rotation direction was changed between 1 mm, 3 mm and 5 mm.

The conventional sample had a uniform thickness of 0.5 mm—i.e., had no thick portions.

During the simulation, to comply with conditions of power distribution to the excitation coil 173, an alternating current of 40000 Hz was supplied to the excitation coil 173, at 7.69 A and 9.65 A before and after achievement of the magnetic shunt effect, respectively.

In the present embodiment, the "increase-decrease rate of heat generation" denotes a value obtained by (i) dividing (a) the difference between an amount of heat generated in the conventional sample and an amount of heat generated in each of the embodiment samples 1, 2 and 3 by (b) the amount of heat generated in the conventional sample, and (ii) expressing a value obtained from this division in percentage terms. The increase-decrease rates of heat generation before and after achievement of the magnetic shunt effect are expressed as Has1(*n*) and Has2(*n*), respectively. Hereinafter, n may be replaced with the number 1, 2 or 3 in association with the reference numbers of the embodiment samples. Has1(*n*), which is the increase-decrease rate of heat generation before the achievement of the magnetic shunt effect, is obtained by the following Expression 1.

$$Has1(n)=(HJ1(n)-HJ1(0))/HJ1(0) \quad \text{(Expression 1)}$$

HJ1(*n*): an amount of heat generated in portions of an embodiment sample (n) that correspond to the contactless portions, before achievement of the magnetic shunt effect HJ1(0): an amount of heat generated in portions of a conventional sample that correspond to the contactless portions, before achievement of the magnetic shunt effect Has2(*n*), which is the increase-decrease rate of heat generation after achievement of the magnetic shunt effect, is obtained by the following Expression 2.

$$Has2(n)=(HJ2(n)-HJ2(0))/HJ2(0) \quad \text{(Expression 2)}$$

Figure 5:
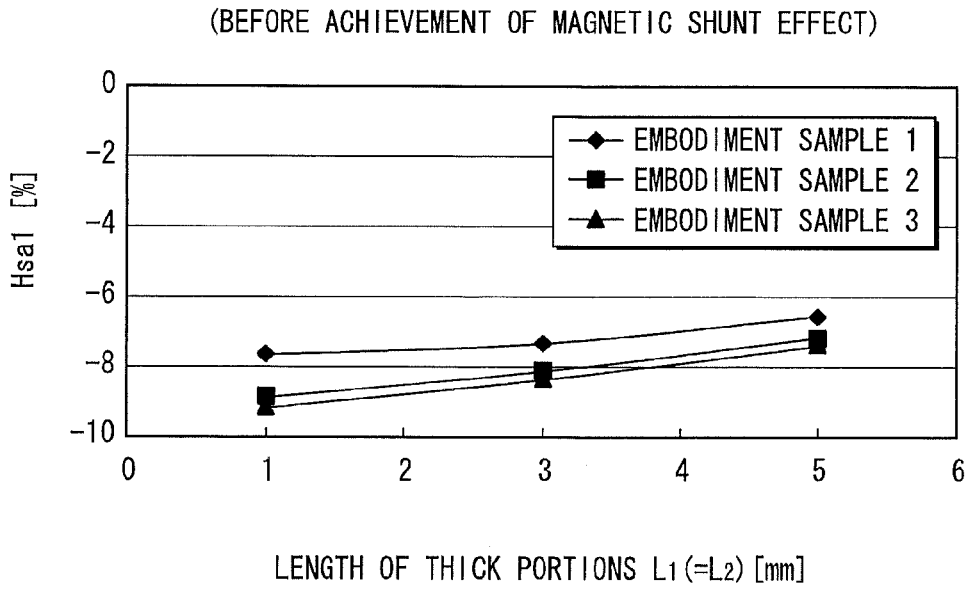
FIG. 5 shows a result of performing the simulation before a magnetic shunt effect is achieved in Embodiment 1.

HJ2(*n*): an amount of heat generated in portions of an embodiment sample (n) that correspond to the contactless portions, after achievement of the magnetic shunt effect HJ2(0): an amount of heat generated in portions of a conventional sample that correspond to the contactless portions, after achievement of the magnetic shunt effect FIG. 5 shows the increase-decrease rate of heat generation Has1 in each of the embodiment samples and the conventional sample before achievement of the magnetic shunt effect.

As shown in FIG. 5, before achievement of the magnetic shunt effect, the amounts of heat generated in the embodiment samples 1, 2 and 3 are each lower than the amount of heat generated in the conventional sample.

Figure 6:
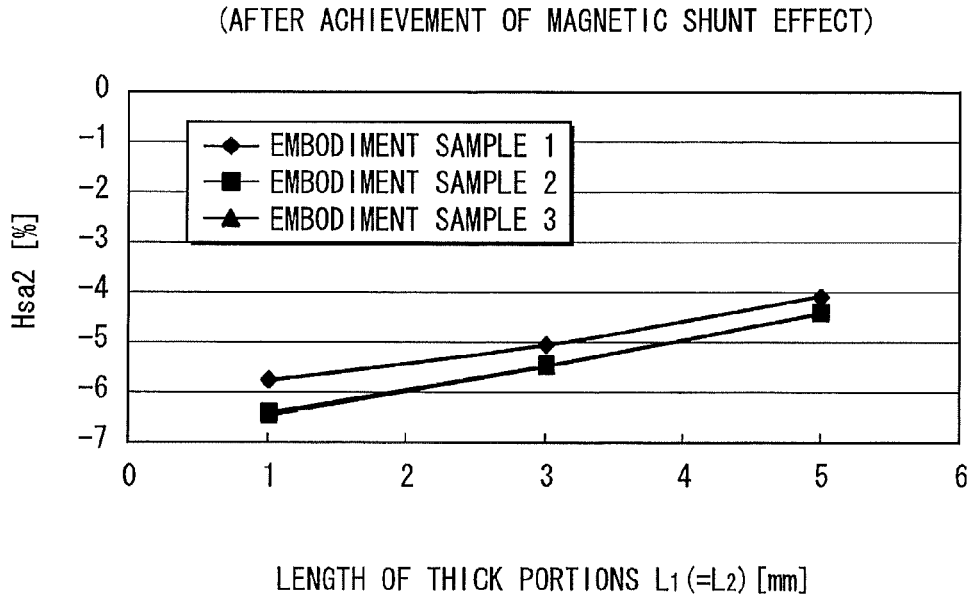
FIG. 6 shows a result of performing the simulation after the magnetic shunt effect is achieved in Embodiment 1.

FIG. 6 shows the increase-decrease rate of heat generation Has2 in each of the embodiment samples and the conventional sample after achievement of the magnetic shunt effect.

Note, in FIG. 6, the lines pertaining to the embodiment samples 2 and 3 overlap each other, and thus look like a single line.

As shown in FIG. 6, after achievement of the magnetic shunt effect, the amounts of heat generated in the embodiment samples 2 and 3, in which the thick portions respectively had thicknesses of 1.5 mm and 2 mm, are each lower than the amount of heat generated in the embodiment sample 1,in which the thick portions had a thickness of 1.0 mm.

Results of the computer simulation performed on the embodiment samples 2 and 3 were similar to each other. It is hence considered that, once the thickness of the thick portions exceeds 1.5 mm, the amount of heat generation cannot be further reduced.

Meanwhile, in order not to extend the warm-up time period, it is desirable that the heat capacity—i.e., the volume (mass)—of the guide plate 156 is as low as possible.

In view of the foregoing, the guide plate 156 of the embodiment sample 2, whose thick portions had a thickness of 1.5 mm and a length of 1 mm, is most suitable of all the test samples.

As set forth above, with the guide plate 156 having a thick portion in each end thereof in the belt rotation direction, the amount of heat generated in the guide plate 156 can be reduced. This, the inventors speculate, is brought about for the following reasons.

The frequency of the alternating magnetic flux generated by the excitation coil 173 is 40000 Hz—i.e., high. Accordingly, the frequency of the eddy current produced in the guide plate 156 is high as well. It is therefore considered that, due to the skin effect, electric current has a tendency to converge on the surface of each end of the guide plate 156.

With the guide plate having the thick portion in each end thereof, on which the electric current has a tendency to converge, the electric current density is thought to be reduced while the eddy current is being produced, thus suppressing the induction-heating of the guide plate 156.

Furthermore, with regard to the thick portions that are effective in suppressing the temperature increase in the guide plate 156, the shorter the lengths $L_1$ and $L_2$ of the thick portions in the belt rotation direction are, the more effectively the temperature of the guide plate 156 can be decreased.

The specific size of the thick portions may be determined by a person skilled in the art in accordance with the above disclosure, an apparatus into which the guide plate is incorporated (whether the apparatus is a high-speed machinery or a low-speed machinery), and other design aspects of the apparatus.

As described above, the present embodiment introduces a guide plate 156 whose both ends in the belt rotation direction are thickened. This simple configuration can suppress the temperature increase in the guide plate 156 especially before the magnetic shunt effect is achieved, without extending the warm-up time period.

<Modifications to Embodiment 1>

Although the present invention has been described based on Embodiment 1, the present invention is of course not limited to Embodiment 1. For example, the following modifications may be made to Embodiment 1.

(1) In Embodiment 1, the thick portions 156*a* and 156*b* of the guide plate 156 had a thickness of 1.5 mm and a length of 1 mm. However, the thick portions 156*a* and 156*b* may not be limited to such measurements, as long as the shape (thickness and length) of the thick portions can reduce the increase-decrease rate of heat generation in the guide plate 156 below the increase-decrease rate of heat generation in the conventional guide plate, after achievement of the magnetic shunt effect.

Figure 7:
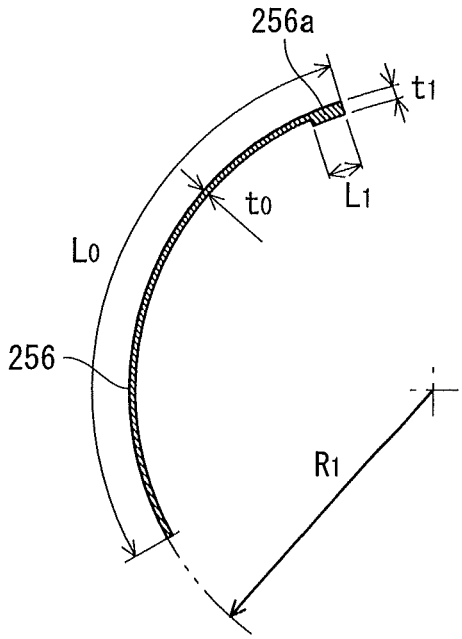
FIG. 7 shows a modification to a guide plate pertaining to Embodiment 1.

(2) In Embodiment 1, each end of the guide plate 156 in the belt rotation direction is the thick portion. The guide plate 156, however, is not limited to this configuration, but may instead be a guide plate 256 one of whose ends in the belt rotation direction is a thick portion 256*a*, as shown in FIG. 7.

Such a guide plate 256 having the thick portion 256*a* in one end thereof still decently yields the effect of suppressing the temperature increase in the guide plate 256 after the magnetic shunt effect is achieved, compared to a guide plate having no thick portions at all.

Figure 8:
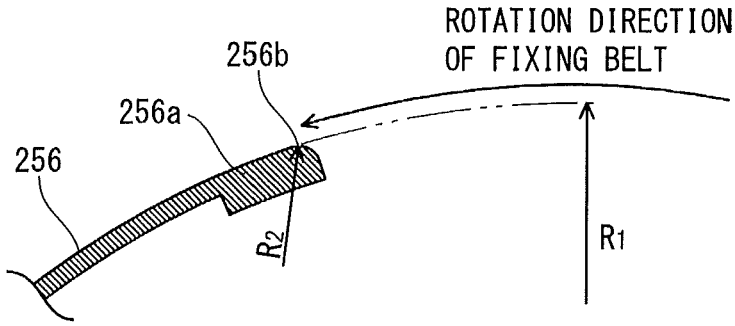
FIG. 8 is an enlarged view showing the modification to the guide plate pertaining to Embodiment 1.

As shown in FIG. 8, in a case where the thick portion 256*a* is one end of the guide plate 256 that is positioned more upstream in the belt rotation direction than the other end, the inner surface of the fixing belt (not illustrated) runs on the edge of the thick portion 256*a*. Because the friction between the fixing belt and the guide plate 256 is more intense in the upstream end than the downstream end of the guide plate 256 in the belt rotation direction, a round part 256*b* having a curvature of $R_2$ may be provided in the outer circumferential edge of the thick portion 256*a* to reduce the stated friction.

It is desirable that the value of this curvature $R_2$ be arbitrarily determined with the following taken into account: (i) the level of reduction of the stated friction; and (ii) the effect of the round part on Has2, which is the increase-decrease rate of heat generation after achievement of the magnetic shunt effect.

Figure 9:
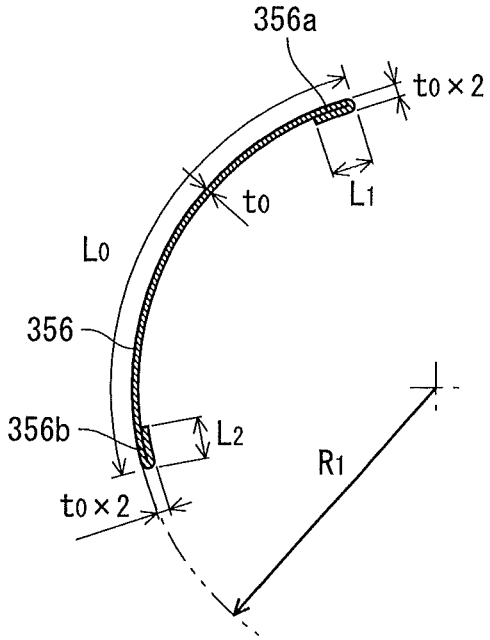
FIG. 9 shows another modification to the guide plate pertaining to Embodiment 1.

(3) In Embodiment 1, the thick portions 156*a* and 156*b* are formed by changing the thickness of both ends of the guide plate 156 in the belt rotation direction. However, the thick portions 156*a* and 156*b* are not limited to being formed in this way. As shown in FIG. 9, a guide plate 356 may be formed by bending both ends of a plate having a substantially uniform thickness of $t_0$ by 180 degrees, the bent ends serving as the thick portions 356*a* and 356*b*.

In this case, the thickness of the thick portions 356*a* and 356*b* is twice as large as $t_0$.

Here, in each of the thick portions 356*a* and 356*b*, inner surfaces of the bent ends, which face each other as a result of the bending, desirably have no gap therebetween.

In the above manner, the thick portions can be easily formed, and the guide plate can be manufactured at low cost.

(4) In Embodiment 1, the total length $L_0$ of the guide plate 156 in the belt rotation direction is 35 mm. However, the total length of the guide plate 156 in the belt rotation direction is not limited to a certain length, but may be arbitrarily determined in accordance with design conditions and the like.

<Embodiment 2>

The configuration of a guide plate 156*a* pertaining to Embodiment 2 is suited to further improve heating efficiency of a fixing device.

Figure 10:
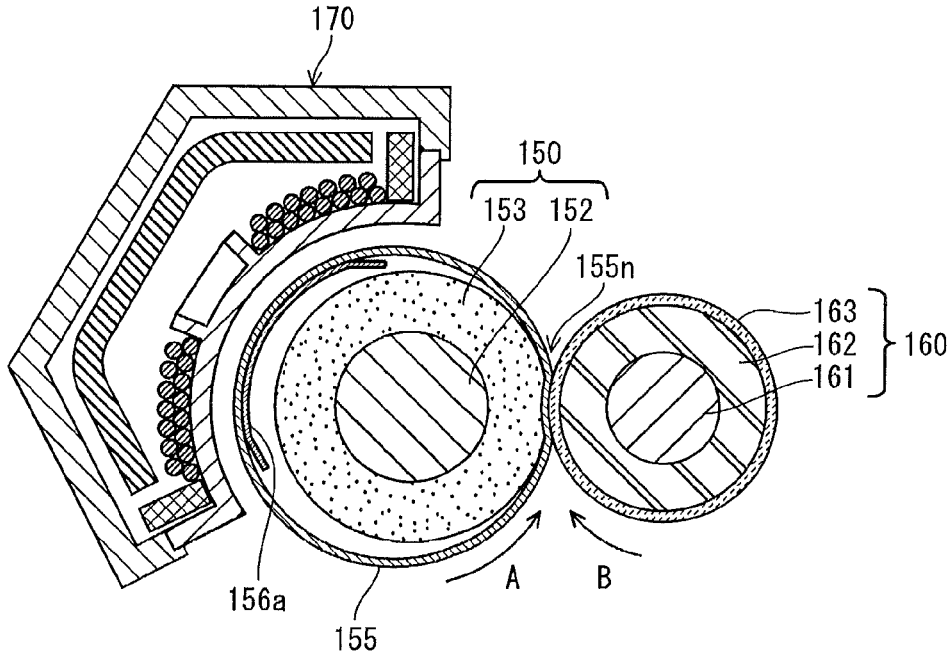
FIGS. 10A and 10B are longitudinal cross-sectional views showing structures of major components of a fixer pertaining to Embodiment 2.
FIG. 10C is a partial cross-sectional view of a fixing belt.
Figure 10:
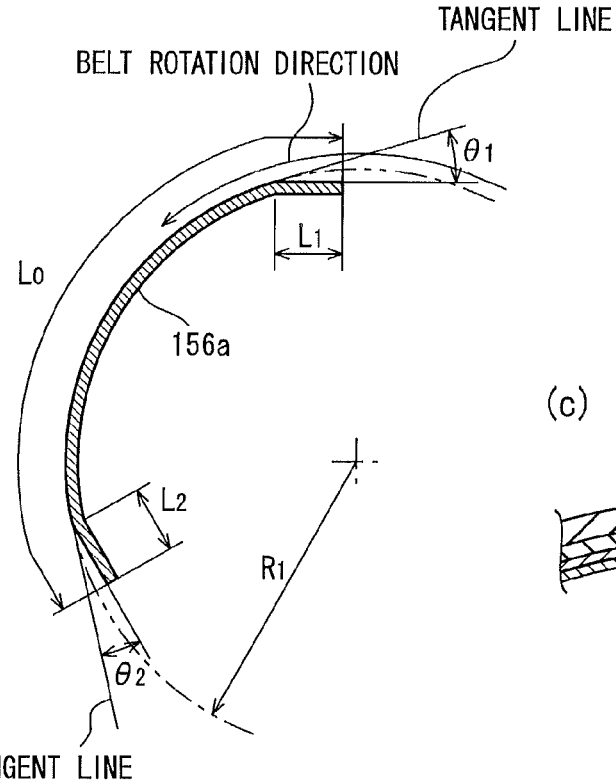
Figure 10:
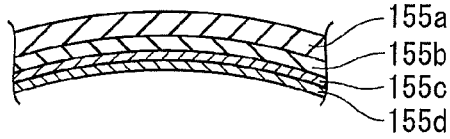

More specifically, as shown in FIG. 10B, the guide plate 156*a* is formed by curving a plate whose total length in the belt rotation direction is $L_o$. Here, the plate is curved so that its outer circumferential surface has a radius of curvature $R_1$. Furthermore, the upstream and downstream ends of the guide plate 156*a* in the belt rotation direction have been bent away from the fixing belt 155, at angles of θ1° and θ2°, and at distances of $L_1$ and $L_2$ from tips thereof, respectively.

Here, the total length $L_0$ is, for example, 35 mm. The radius of curvature $R_1$ is 20 mm. The lengths $L_1$ and $L_2$ of the bent ends are each 3.5 mm. The bending angles θ1° and θ2°, by which the ends of the guide plate 156*a* have been bent, are each 15°.

As is the case with Embodiment 1, the radius of curvature $R_1$ of the guide plate 156*a* is substantially equal to the radius of curvature of the inner surface of a portion of the fixing belt 155 that is facing the magnetic flux generator 170 when the fixed belt 155 is not rotating.

After the temperature of the contactless portions of the magnetic shunt alloy layer 155*d* has exceeded the Curie temperature and has thus turned from ferromagnetic to nonmagnetic (e.g., after the magnetic shunt effect is achieved), the magnetic flux generated by the magnetic flux generator 170 penetrates through the heat generation layer 155*c* and the magnetic shunt alloy layer 155*d*, and further breaks into the guide plate 156*a*.

At this time, as is the case with Embodiment 1, the guide plate 156*a* generates magnetic flux that proceeds in the opposite direction from the magnetic flux that is breaking into the guide plate 156*a*. This reduces the magnetic flux density in and in the vicinity of the guide plate 156*a*, thus suppressing overheating of the heat generation layer 155*c*.

Effects of Bending Ends of Guide Plate 156*a*

The inventors have discovered through diligent studies that, by bending both ends of the guide plate 156*a* in the belt rotation direction, the heating efficiency of the heat generation layer 155*c* in the fixing belt 155 is improved before achievement of the magnetic shunt effect, resulting in the reduction of power consumption.

Results of Simulation

To verify the above effects, i.e., the improvement in the heating efficiency of the heat generation layer 155*c* in the fixing belt 155 before achievement of the magnetic shunt effect, the inventors computer simulated the relationship between an amount of heat generated in the fixing belt 155 before achievement of the magnetic shunt effect and the configuration of the bent ends of the guide plate 156*a*, by using the finite element method. The following results were acquired.

Specifications of Test Samples

FIG. 11 shows specifications of guide plates provided as embodiment samples 1, 2 and 3 (pertaining to the present invention) and a conventional guide plate provided as a conventional sample, which were all subjected to the simulation.

As shown in FIG. 11, both ends of the embodiment samples 1, 2 and 3 in the belt rotation direction were bent by 10°, 15° and 20°, respectively.

Here, the simulation was performed three times each on the embodiment samples 1, 2 and 3,in which the length of the bent ends was changed between 1.7 mm, 3.5 mm and 5.2 mm.

Each guide plate had a thickness $t_0$ of 0.5 mm. The total length $L_0$ of each guide plate in the belt rotation direction was 35 mm.

During the simulation, an alternating current having a frequency of 40000 Hz was supplied to the excitation coil 173 at 10 A (half amplitude) before achievement of the magnetic shunt effect.

Also during the simulation, the inventors calculated an amount of heat generated in the fixing belt per an electric current of 1 A supplied to the excitation coil 173, when the fixing belt was accompanied by each of the conventional sample and the embodiment samples 1, 2 and 3 having the bent ends of different lengths.

Figure 12:
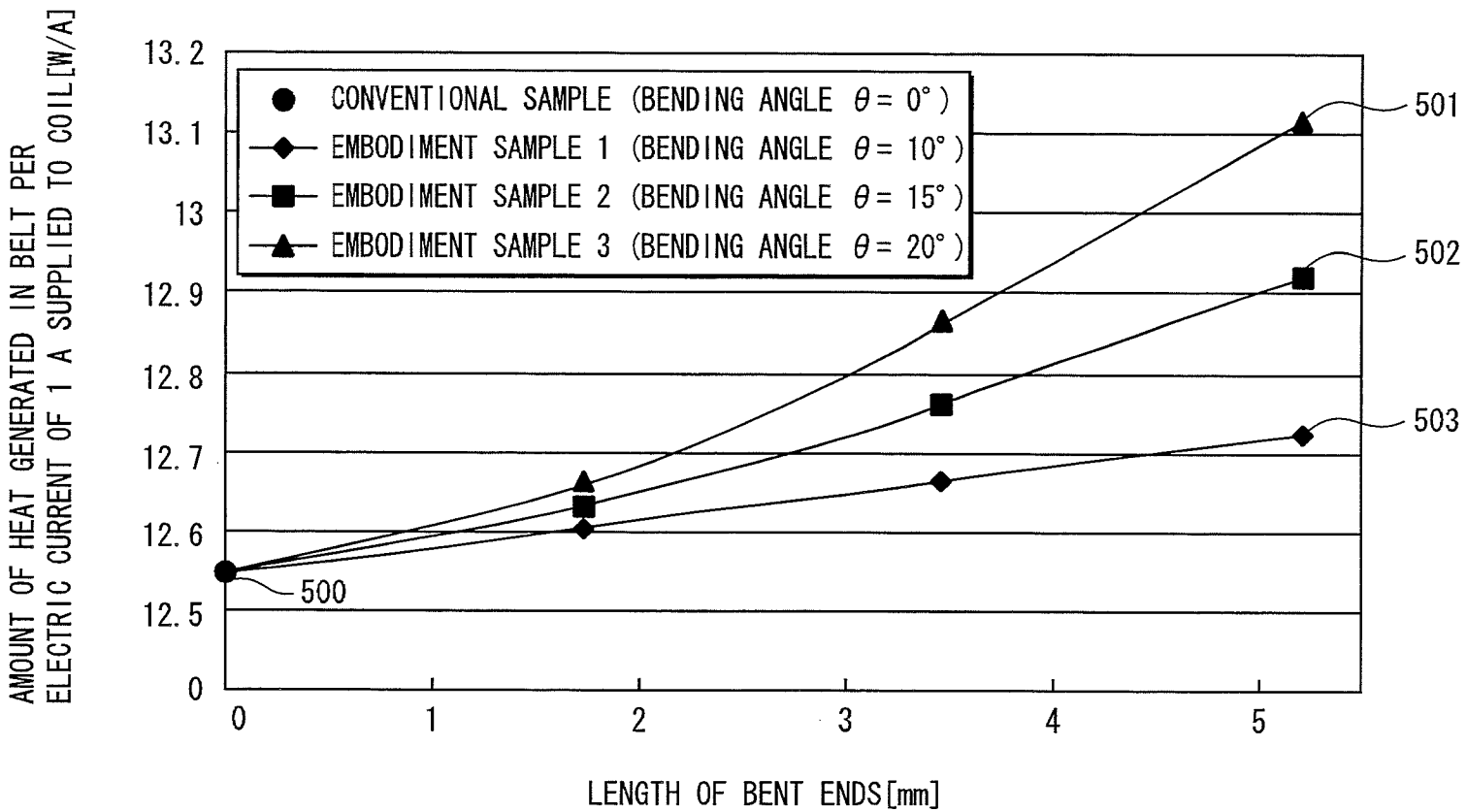
FIG. 12 shows a result of performing the simulation pertaining to Embodiment 2.

FIG. 12 shows an amount of heat generated in the fixing belt per an electric current of 1 A supplied to the excitation coil before achievement of the magnetic shunt effect, when the fixing belt was accompanied by each of the embodiment samples and the conventional sample.

In the graph of FIG. 12, the horizontal axis indicates the length [mm] of the bent ends of the guide plate 156*a*, and the vertical axis indicates an amount of heat generated per an electric current of 1 A supplied to the excitation coil [W/A].

In FIG. 12, the point 500 indicates a simulation result obtained when the fixing belt was accompanied by the conventional sample. The points 501, 502 and 503 indicate simulation results obtained when the fixing belt was accompanied by the embodiment samples 1, 2 and 3 (in which both ends were bent by bending angles of 10°, 15° and 20°), respectively.

The amount of heat generated in the fixing belt accompanied by the embodiment samples 1, 2 or 3 was higher than the amount of heat generated in the fixing belt accompanied by the conventional example. This indicates that the larger the bending angle of the bent ends of the guide plate 156*a*, and the longer the bent ends, the larger the amount of heat generated in the fixing belt per an electric current of 1 A supplied to the excitation coil, and the higher the heating efficiency of the fixing belt.

Therefore, it is desirable to configure the guide plate 156*a* in such a manner that its ends are bent to the largest degree possible, and the bent ends are as long as possible. In reality, however, the bending angle and the length of the bent ends are restricted due to certain design restrictions.

In the present embodiment, for the purpose of reducing the warm-up time period, the length of the fixing belt 155 has been shortened—i.e., the heat capacity of the fixing belt 155 has been reduced. Consequently, the clearance between the fixing roller 150 and the fixing belt 155 is small. For this reason, even if one intends to increase the length and bending angle of the bent ends without tips of the bent ends interfering with the fixing roller 150, the lengths $L_1$ and $L_2$ of the bent ends can only be increased to 3 mm to 4 mm, and the bending angles θ1° and θ2° of the bent ends can only be increased to 10° to 20°, at most.

One way to raise such size restrictions on the bent ends is to increase the clearance between the fixing roller 150 and the fixing belt 155 by extending the length of the fixing belt 155. This, however, will increase the heat capacity of the fixing belt 155, thus reducing the heating efficiency thereof. Another way is to reduce the outer diameter of the fixing roller 150, without changing the length of the fixing belt 155. This, however, will reduce the width of the fixing nip 155*n*, and does not always guarantee the desired fixing quality.

For the above reasons, increasing the clearance between the fixing roller 150 and the fixing belt 155 is detrimental. In other words, size restrictions on the guide plate 156*a* cannot be removed.

As described earlier, in the guide plate 156*a* of the present embodiment, the bending angles θ1° and θ2° of the bent ends are each 15°, and the lengths $L_1$ and $L_2$ of the bent ends are each 3.5 mm (equal). However, as one of the bent ends having the length of $L_2$ is positioned at a longer distance from the fixing roller 150 than the other one of the bent ends having the length of $L_1$ in the present embodiment, the bent ends may be configured to satisfy the following relation: $L_2>L_1$.

As set forth above, by bending both ends of the guide plate 156*a* in the belt rotation direction away from the fixing belt 155, the amount of heat generated in the fixing belt 155 is increased. This, the inventors speculate, is brought about by the following reasons.

Even when the magnetic shunt alloy layer is at or below a predetermined temperature and is therefore ferromagnetic, the magnetic shunt alloy layer cannot capture the entire magnetic flux generated by the magnetic flux generator 170. That is, leaked magnetic flux reaches the inside of the rotation path of the fixing belt 155.

As the frequency of the alternating magnetic flux generated by the magnetic flux generator 170 is high (in the present embodiment, 400000 Hz), the frequency of the eddy current produced in the guide plate 156*a* is high as well. It is therefore considered that, due to the skin effect, the eddy current has a tendency to converge, especially on the surface of each end of the guide plate 156*a*.

The eddy current, which is generated due to the leaked magnetic flux that has broken into the surface of each end of the guide plate 156*a*, causes generation of canceling magnetic flux that proceeds in the opposite direction from the leaked magnetic flux. The canceling magnetic flux cancels out a part of the magnetic flux generated by the magnetic flux generator 170, and accordingly reduces the magnetic flux density of the magnetic flux penetrating through the heat generation layer of the fixing belt 155.

However, according to the present embodiment, ends of the guide plate 156*a* are each bent away from the fixing belt 155, thus positioned at a longer distance from the magnetic flux generator 170 than ends of a guide plate that are not bent. Accordingly, the amount of leaked magnetic flux converging on the surface of each end would be smaller when each end has been bent than when each end has not been bent. As a result, the absolute amount of the canceling magnetic flux on the surface of each end of the guide plate 156*a* will be reduced, and the amount of the magnetic flux to be cancelled out, among the entire magnetic flux generated by the magnetic flux generator 170, will be reduced as well. Due to the further increase in the amount of magnetic flux that contributes to heating the heat generation layer in comparison to conventional technology, the heating efficiency is thought to be improved over conventional technology.

As described above, the present embodiment can increase the heating efficiency by simply configuring the guide plate 156*a* in such a manner that ends of the guide plate 156*a* in the belt rotation direction are bent away from the fixing belt 155.

Also, with the ends of the guide plate 156*a* thus bent, edges of the ends of the guide plate 156*a* in the belt rotation direction do not come in contact with the inner surface of the fixing belt 155 like those of a conventional guide plate do.

That is to say, the present embodiment has the effects of reducing the friction between the guide plate 156*a* and the fixing belt 155, and improving durability of the fixing belt 155.

<Modifications to Embodiment 2>

Although the foregoing has described the present invention based on Embodiment 2, the present invention is of course not limited to Embodiment 2. For example, the following modifications may be made to Embodiment 2.

(1) In Embodiment 2, both ends of the guide plate 156*a* in the belt rotation direction have been bent. The guide plate 156*a*, however, should not be limited to being constructed in this manner. A guide plate 156*a* having one of its ends bent would still decently yield the effect of improving the heating efficiency and durability of the fixing belt 155, compared to a conventional guide plate neither of whose ends has been bent.

Note, in a case where one end of the guide plate 156*a* is bent, it is desirable that the bent end be positioned more upstream in the belt rotation direction than the other end that has not been bent.

That is to say, in a conventional guide plate that has been curved so that its outer circumferential surface has a uniform radius of curvature $R_1$, edges of both ends of the conventional guide plate in the belt rotation direction are in contact with the inner surface of the fixing belt 155. In particular, the inner surface of the fixing belt 155 and the edge of one end of the conventional guide plate that is positioned more upstream in the belt rotation direction than the other end create intense friction against each other in the counter directions, with the result that the fixing belt 155 can easily be worn. However, by bending one end of the guide plate 156*a* that is positioned more upstream in the belt rotation direction than the other end, a round part is formed in the most upstream edge of the guide plate 156*a* that is in contact with the inner surface of the fixing belt 155. The friction between the guide plate 156*a* and the fixing belt 155 in this round part is reduced, making the fixing belt 155 less susceptible to deterioration.

Figure 13:
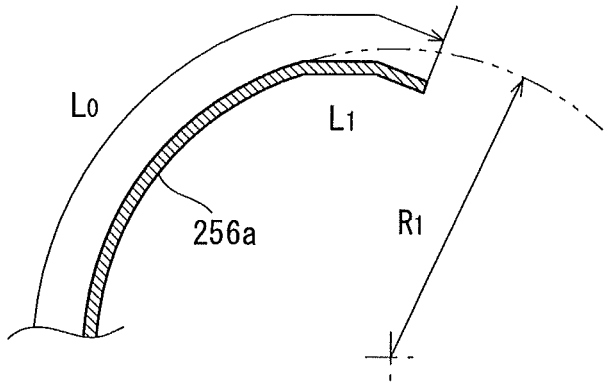
FIG. 13 shows a modification to a guide plate pertaining to Embodiment 2.
Figure 14:
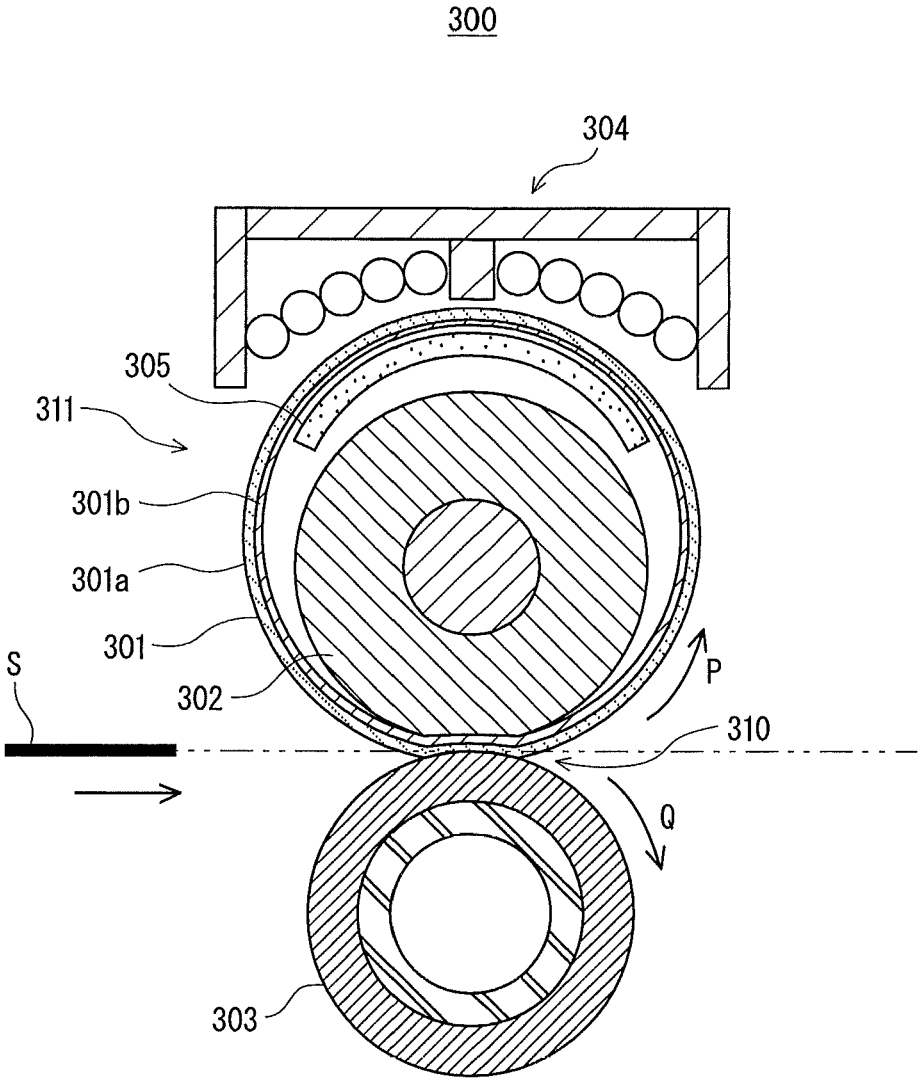
FIG. 14 is a cross-sectional view of a conventional fixer.

(2) In the guide plate 156*a* of Embodiment 2, each end has been bent only once. However, the guide plate 156*a* may be replaced with a guide plate 256*a* each of whose ends has been bent in a multi-step manner, as shown in FIG. 13.

(3) Although the radius of curvature $R_1$, the inner diameter of the fixing belt 155, and the outer diameter of the fixing roller 150 have been respectively described to be 20 mm, 40 mm, and 36 mm in Embodiment 2, they are not limited to these measurements. Their sizes may be arbitrarily determined in accordance with design conditions, such as the heat capacity of the fixing belt 155 and the width of the fixing nip.

Also, the total length $L_0$ of the guide plate in the belt rotation direction, the lengths $L_1$ and $L_2$ of the bent ends, and the bending angles θ1° and θ2° of the bent ends may be arbitrarily determined, as long as the guide plate 156*a* and the fixing roller 150 do not interfere with each other.

(Other Modifications)

(1) According to Embodiments 1 and 2, the guide plate 156 and the guide plate 156*a* are each made from a nonmagnetic, low-resistance and electrically conductive material. Each guide plate, however, is not limited to being made from such a material. For example, the guide plate 156*a* may have a multi-layer structure—i.e., may be composed of a plurality of layers-including a low-resistance and electrically conductive layer.

Other than the low-resistance and electrically conductive layer, said plurality of layers may include a low friction layer that can reduce friction against the fixing belt 155 with its surface PTEF-coated etc., the low friction layer being a layer that comes into contact with the fixing belt 155.

In the guide plate 156 thus configured, at least one of ends of the low-resistance and electrically conductive layer in the belt rotation direction may be a thick portion that has a thickness larger than the thickness of a central portion of the low-resistance and electrically conductive layer.

The present invention has been explained in Embodiments 1 and 2 as being applied to a tandem color printer. However, the present invention is not limited to being applied to such a printer but may instead be applied to a monochrome printer and an apparatus having additional functions such as a photocopy function and a facsimile function. In other words, the present invention may be applied to any image formation apparatus comprising a fixing device that utilizes a fixing belt and a guide plate that guides the fixing belt in its rotation direction.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A fixing device for thermally fixing onto a sheet, an unfixed image formed on the sheet, the fixing device comprising:

an endless belt that is heated by electromagnetic induction while being driven to rotate;

a curved member that is positioned inside a rotation path of the belt and that is curved in an arc shape along the rotation path of the belt, wherein both ends of the curved member, in terms of direction of the rotation path, are unattached and at least one of the ends is bent in a direction away from the belt;

a magnetic flux generator that (i) is positioned outside the rotation path of the belt, facing the curved member with the belt in between, and (ii) generates magnetic flux for heating the belt;

a heat generation layer that is provided on the belt and that generates heat due to the magnetic flux;

a magnetic shunt alloy layer that is provided along the curved member, facing a protruding side of the curved member, and that reversibly turns from ferromagnetic to nonmagnetic when a temperature thereof has exceeded a predetermined temperature; and a magnetic flux nullifying layer that is provided on the curved member and that generates a magnetic flux that proceeds in an opposite direction to the magnetic flux generated by the magnetic flux generator, that breaks into the curved member when the magnetic shunt alloy layer turns from ferromagnetic to nonmagnetic.

2. An image formation apparatus comprising the fixing device of claim 1.

3. A fixing device for thermally fixing onto a sheet, an unfixed image formed on the sheet, the fixing device comprising:

an endless belt that is heated by electromagnetic induction while being driven to rotate;

a curved member that is positioned inside a rotation path of the belt and that is curved in an arc shape along the rotation path of the belt, wherein both ends of the curved member, in terms of direction of the rotation path, are unattached and at least one of the ends is thicker than a central part of the curved member;

a magnetic flux generator that is positioned outside the rotation path of the belt, facing the curved member with the belt in between, and that generates magnetic flux for heating the belt;

a heat generation layer that is provided on the belt and that generates heat due to the magnetic flux;

a magnetic shunt alloy layer that is provided along the curved member, facing a protruding side of the curved member, and that reversibly turns from ferromagnetic to nonmagnetic when a temperature thereof has exceeded a predetermined temperature; and a magnetic flux nullifying layer that is provided on the curved member and that generates a magnetic flux that proceeds in an opposite direction to the magnetic flux generated by the magnetic flux generator, that breaks into the curved member when the magnetic shunt alloy layer turns from ferromagnetic to nonmagnetic.

4. An image formation apparatus comprising the fixing device of claim 3.

* * * * *